US008977183B2

(12) United States Patent
Goda

(10) Patent No.: US 8,977,183 B2
(45) Date of Patent: Mar. 10, 2015

(54) CLEANING DEVICE, AND IMAGE CARRIER UNIT AND IMAGE FORMING APPARATUS HAVING SAME

(71) Applicant: KYOCERA Document Solutions Inc., Osaka-shi, Osaka (JP)

(72) Inventor: Mitsuhiro Goda, Osaka (JP)

(73) Assignee: KYOCERA Document Solutions Inc. (JP)

( * ) Notice: Subject to any disclaimer, the term of this patent is extended or adjusted under 35 U.S.C. 154(b) by 25 days.

(21) Appl. No.: 13/778,613

(22) Filed: Feb. 27, 2013

(65) Prior Publication Data

US 2013/0223904 A1 Aug. 29, 2013

(30) Foreign Application Priority Data

Feb. 29, 2012 (JP) ..... 2012-043416

(51) Int. Cl.
*G03G 21/00* (2006.01)

(52) U.S. Cl.
CPC ..... *G03G 21/0005* (2013.01); *G03G 21/0011* (2013.01); *G03G 21/007* (2013.01)
USPC ..... 399/349

(58) Field of Classification Search
CPC ..... G03G 21/0005
USPC ..... 399/349
See application file for complete search history.

(56) References Cited

U.S. PATENT DOCUMENTS 4,910,560 A * 3/1990 Kanada ..... 399/343
5,305,067 A * 4/1994 Song ..... 399/93
5,585,894 A * 12/1996 Araya et al. ..... 399/114
5,991,568 A * 11/1999 Ziegelmuller et al. ..... 399/102
6,269,236 B1 * 7/2001 Mori et al. ..... 399/354
6,701,122 B2 3/2004 Maeshima et al.
7,110,696 B2 * 9/2006 Murakami et al. ..... 399/350
7,272,354 B2 * 9/2007 Murakami et al. ..... 399/347
7,773,933 B2 * 8/2010 Ishino et al. ..... 399/349
8,335,463 B2 * 12/2012 Fujimori ..... 399/350
2003/0053831 A1 * 3/2003 Maeshima et al. ..... 399/349
2004/0146309 A1 * 7/2004 Shu et al. ..... 399/27
2004/0208668 A1 * 10/2004 Kurihara et al. ..... 399/102
2008/0152408 A1 * 6/2008 Kawakami et al. ..... 399/351
2011/0091243 A1 * 4/2011 Tomino et al. ..... 399/123
2013/0336694 A1 * 12/2013 Kadota et al. ..... 399/349

FOREIGN PATENT DOCUMENTS

JP 2003-98924 4/2003

* cited by examiner

*Primary Examiner* — Clayton E Laballe
*Assistant Examiner* — Arlene Heredia Ocasio
(74) *Attorney, Agent, or Firm* — Gerald E. Hespos; Michael J. Porco; Matthew T. Hespos

(57) ABSTRACT

A cleaning device includes a case, a rotating member, a sheet member, and a cover member. The rotating member includes a peripheral face which comes into contact with the cylindrical face of an image carrier, is rotatively driven in a same direction as the image carrier at a contact position, and recovers a toner which has attached on the image carrier. The sheet member extends toward a direction approaching a straight line that connects the rotating axis of the image carrier and the contact position of the rotating member, and includes a leading end which comes into contact with the cylindrical face. The cover member is provided in the case so as to cover an upside of the sheet member, extends toward the direction approaching the straight line, and reaches a position above the leading end of the sheet member.

12 Claims, 8 Drawing Sheets

CLEANING DEVICE, AND IMAGE CARRIER UNIT AND IMAGE FORMING APPARATUS HAVING SAME

This application relates to and claims priority from Japanese Patent Application No. 2012-043416, filed on Feb. 29, 2012 in the Japan Patent Office, the entire disclosure of which is incorporated herein by reference.

BACKGROUND

The present disclosure relates to a cleaning device for cleaning an image carrier which carries a toner image, and an image carrier unit and an image forming apparatus having such a cleaning device.

Conventionally, as an image forming apparatus for forming an image on a sheet, known is technology of a sheet passing through a transfer nip part, which is formed between a photoreceptor drum and a transfer roller, in a direction from down to up. A toner image is formed on the photoreceptor drum, and the toner image is transferred to the sheet at the transfer nip part. The image forming apparatus further includes a fixing unit, and the sheet to which the toner image was transferred is subject to fixation processing by the fixing unit, and then discharged.

With the foregoing conventional technology, a cleaning device is disposed facing the photoreceptor drum in order to clean the residual toner on the photoreceptor drum after the toner image is transferred at the transfer nip part. As described above, when the sheet passes through the transfer nip part in a direction from down to up, the cleaning device that is disposed on the further downstream side in the rotating direction of the photoreceptor drum than the transfer nip part is often disposed above the photoreceptor drum.

When the cleaning member is disposed above the photoreceptor drum, there are cases where the residual toner that was removed from the photoreceptor drum falls from the periphery of the cleaning member. Thus, a toner seal member is disposed to come into contact with the photoreceptor drum around the cleaning member in order to prevent the residual toner from falling. Nevertheless, when a large amount of toner is accumulated above the toner seal member, such toner will press the toner seal member toward the photoreceptor drum. Thus, the contact pressure of the toner seal member against the photoreceptor drum will increase. Meanwhile, when paper dust of the sheet becomes attached to the cylindrical face of the photoreceptor drum at the transfer nip part, there are cases where the paper dust is moved to the leading end of the toner seal member in response to the rotation of the photoreceptor drum. When the contact pressure of the toner seal member against the photoreceptor drum is high as described above, the paper dust becomes a clump between the leading end of the toner seal member and the cylindrical face of the photoreceptor drum. Consequently, there are cases where the leading end of the toner seal member lifts due to the clump of the paper dust, and cause defects such as toner leakage.

SUMMARY

The cleaning device according to one aspect of the present disclosure is disposed above an image carrier including a rotating axis, and a cylindrical face which rotates in one direction around the rotating axis and carries a toner image, and cleans the cylindrical face. The cleaning device includes a case, a rotating member, a sheet member, and a cover member. The rotating member is provided in the case, includes a peripheral face which comes into contact with the cylindrical face above the rotating axis in a cross section view that is orthogonal to the rotating axis, is rotatively driven in a same direction as the image carrier at a contact position which comes into contact with the cylindrical face, and recovers a toner which has attached on the image carrier. The sheet member is provided in the case, extends, in the cross section view, from a position that is above the rotating axis and separated from the cylindrical face toward a direction approaching a straight line that connects the rotating axis of the image carrier and the contact position of the rotating member, and includes a leading end which comes into contact with the cylindrical face on a side that is further upstream in the rotating direction of the image carrier than the rotating member. The cover member is provided in the case so as to cover an upside of the sheet member, extends from a position that is separated from the cylindrical face in the cross section view toward a direction approaching the straight line, and reaches a position above the leading end of the sheet member.

Moreover, the image carrier unit according to another aspect of the present disclosure includes the foregoing cleaning device, and the image carrier. The image carrier is disposed facing the rotating member.

Moreover, the image forming apparatus according to another aspect of the present disclosure includes the foregoing cleaning device, the image carrier, and a developing device. The image carrier is disposed facing the rotating member. The developing device supplies a toner to the cylindrical face of the image carrier.

DETAILED DESCRIPTION

Figure 1:
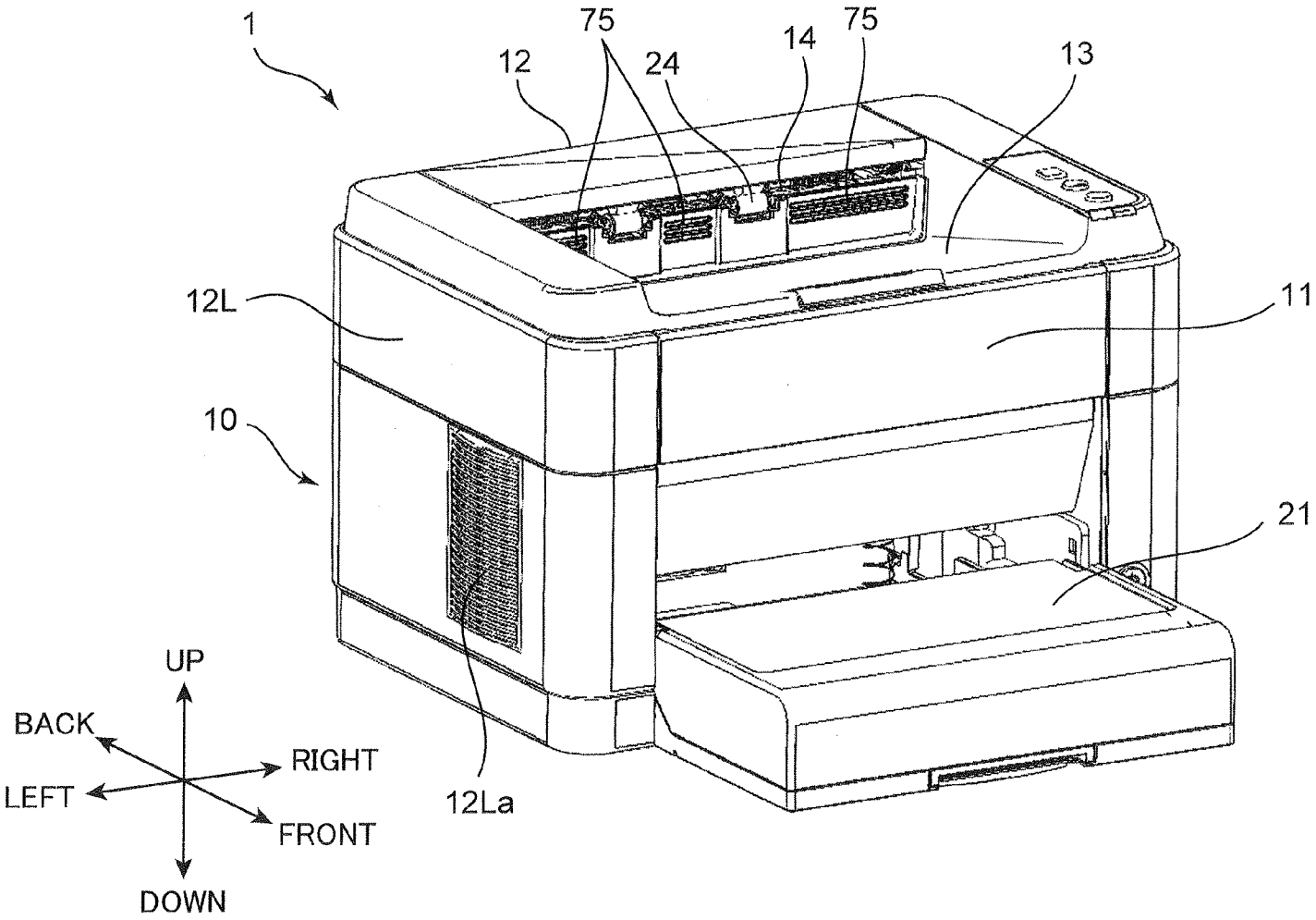
FIG. 1 is a perspective view showing the appearance of the image forming apparatus according to one embodiment of the present disclosure.
Figure 2:
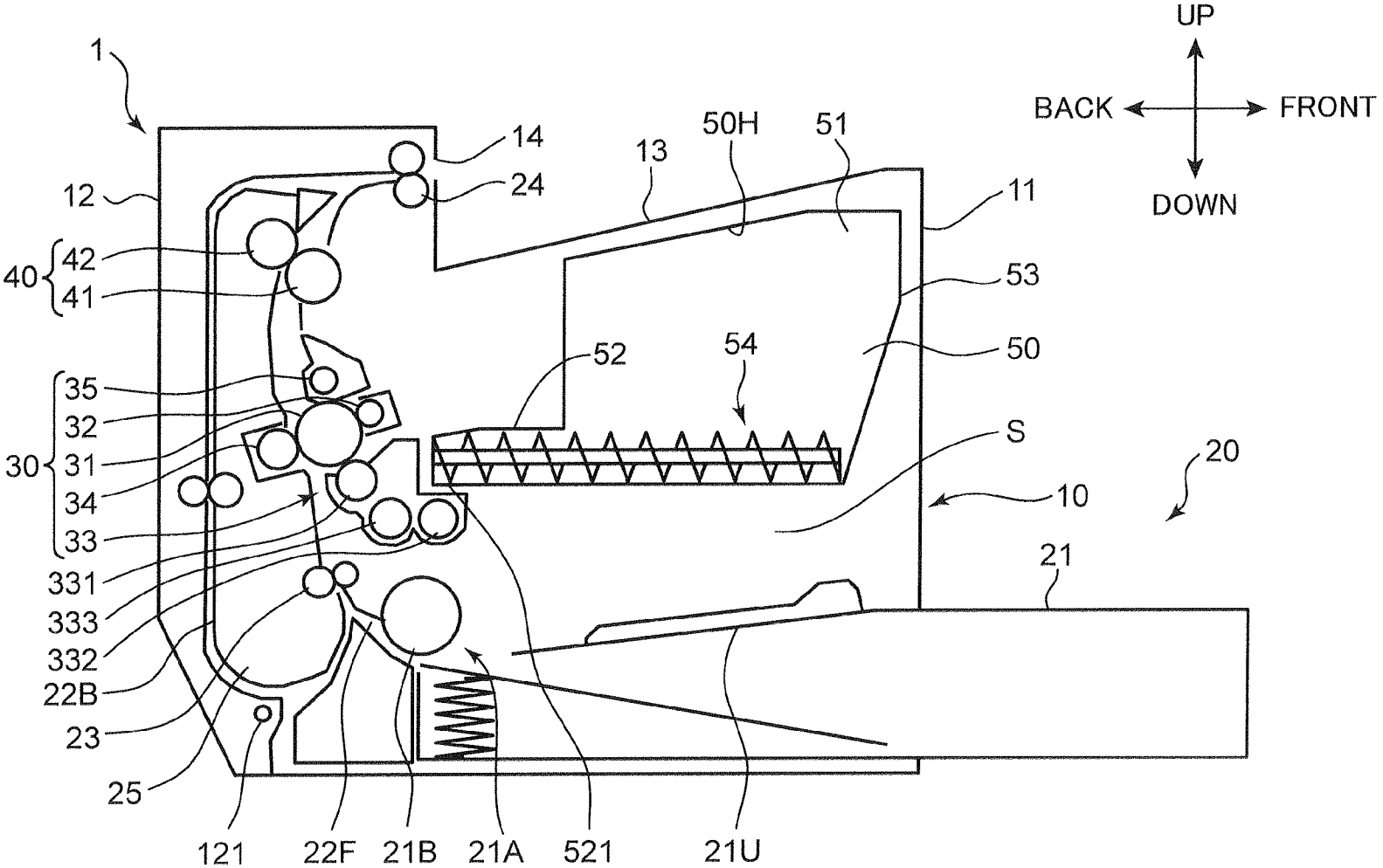
FIG. 2 is a lateral cross section showing the internal structure of the image forming apparatus according to one embodiment of the present disclosure.

Embodiments of the present disclosure are now explained in detail with reference to the appended drawings. FIG. 1 is a perspective view showing the appearance of the image forming apparatus 1 according to one embodiment of the present disclosure. Moreover, FIG. 2 is a lateral cross section showing the internal structure of the image forming apparatus 1 according to one embodiment of the present disclosure. Here, while a black-and-white printer is illustrated as the image forming apparatus 1, the image forming apparatus may also be a copier, a facsimile machine, or a multi-function product having their functions, or an image forming apparatus which forms color images.

The image forming apparatus 1 includes a body housing 10 which has a substantially rectangular case structure, and a paper feeding unit 20, an image forming unit 30, a fixing unit 40 and a toner container 50 which are housed in the body housing 10.

A front cover 11 is provided on a front face side of the body housing 10 and a rear cover 12 is provided on a rear face side of the body housing 10, respectively. As a result of the front cover 11 being opened, the toner container 50 becomes exposed on the front face side. Consequently, the user can remove the toner container 50 from the front face side of the body housing 10 when the toner is used up. The rear cover 12 is a cover that is opened upon a sheet jam or for maintenance. The image forming unit 30 and the fixing unit 40 can be respectively removed from the rear face side of the body housing 10 as a result of the rear cover 12 being opened. Moreover, a left cover 12L (FIG. 1) is provided to a side face of the body housing 10 and a right cover 12R (not shown in FIG. 1) is provided to a side that is opposite to the left cover 12L, respectively, in a manner of extending in the vertical direction. An inlet 12La for incorporating air into the body housing 10 is provided to the front side portion of the left cover 12L. Moreover, the top face of the body housing 10 has a paper discharging unit 13 to which a sheet, after an image is formed thereon, is discharged. Various devices for executing image formation are mounted in an internal space S (FIG. 2) which is demarcated by the front cover 11, the rear cover 12, the left cover 12L, the right cover 12R, and the paper discharging unit 13.

The paper feeding unit 20 includes a paper feeding cassette 21 for housing the sheets that were subject to the image forming process (FIG. 2). A part of the paper feeding cassette 21 protrudes further forward from the front face of the body housing 10. Of the paper feeding cassette 21, the top face of the portion that is housed in the body housing 10 is covered by a paper feeding cassette top panel 21U. The paper feeding cassette 21 has a sheet housing space where a bundle of sheets is housed, and a lift plate for lifting the bundle of sheets for paper feeding. A sheet supplying unit 21A is provided to the top part on the rear end side of the paper feeding cassette 21. The sheet supplying unit 21A is provided with a paper feed roller 21B for supplying, one sheet at a time, the uppermost sheet of the sheet bundle in the paper feeding cassette 21.

The image forming unit 30 performs the image forming process of forming a toner image on the sheet that is fed from the paper feeding unit 20. The image forming unit 30 includes a photoreceptor drum 31 (image carrier), and a charging device 32, an exposure device (not shown in FIG. 2), a developing device 33, a transfer roller 34 and a cleaning device 35 which are disposed around the photoreceptor drum 31. The image forming unit 30 is disposed between the left cover 12L and the right cover 12R.

Figure 3:
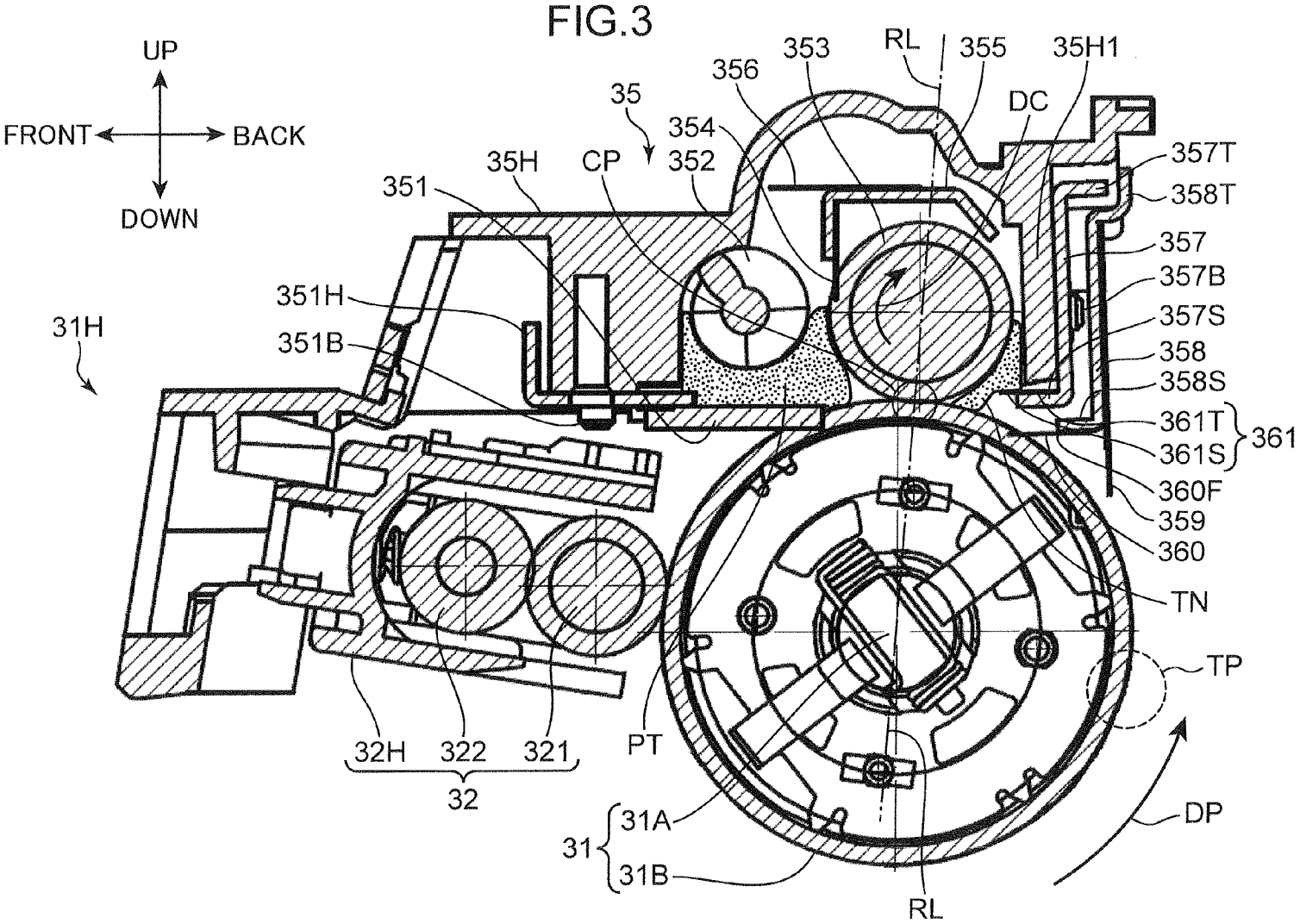
FIG. 3 is a lateral cross section showing the internal structure of the image carrier unit according to one embodiment of the present disclosure.

The photoreceptor drum 31 includes a rotating axis 31A, and a cylindrical face 31B which rotates around the rotating axis 31A (FIG. 3). An electrostatic latent image is formed on the cylindrical face 31B, and a toner image according to the electrostatic latent image is carried on the cylindrical face 31B. As the photoreceptor drum 31, a photoreceptor drum configured from an amorphous silicon (a-Si)-based material may be used.

The charging device 32 is used for uniformly charging the surface of the photoreceptor drum 31, and includes a charge roller which comes into contact with the photoreceptor drum 31.

The cleaning device 35 includes a cleaning blade and the like. The cleaning device 35 cleans the toner that became attached to the peripheral face of the photoreceptor drum 31 after the transfer of the toner image, and conveys the toner to a recovery device not shown. Moreover, the photoreceptor drum 31, the charging device 32, and the cleaning device 35 are configured integrally as a drum unit 31H (refer to FIG. 3) (image carrier unit). The cleaning device 35 and the drum unit 31H will be described later in detail.

The exposure device includes optical components such as a laser light source, a mirror, and a lens. The exposure device forms an electrostatic latent image on the cylindrical face 31B of the photoreceptor drum 31 by irradiating a laser beam that was modulated based on the image data provided from an external device such as a personal computer. The developing device 33 supplies a toner to the cylindrical face 31B of the photoreceptor drum 31 for developing the electrostatic latent image and forming the toner image on the photoreceptor drum 31. The developing device 33 includes a developing roller 331 for carrying the toner to be supplied to the photoreceptor drum 31, and a first agitating screw 332 and a second agitating screw 333 for circulating and conveying, while agitating, the developer in a development housing not shown.

The transfer roller 34 is a roller for transferring, onto the sheet, the toner image formed on the cylindrical face 31B of the photoreceptor drum 31. The transfer roller 34 comes into contact with the cylindrical face 31B of the photoreceptor drum 31, and forms a transfer nip part TP (FIG. 3). A transfer bias of reverse polarity to the toner is applied to the transfer roller 34.

The fixing unit 40 performs fixation processing of fixing the transferred toner image onto the sheet. The fixing unit 40 includes a fixing roller 41 internally having a heat source, and a pressure roller 42 pressed against the fixing roller 41 and forms a fixation nip part with the fixing roller 41. When the sheet to which the toner image was transferred is passed through the fixation nip part, the toner image is fixed onto the sheet based on the heating by the fixing roller 41 and the pressurization by the pressure roller 42.

The toner container 50 stores the toner to be supplied to the developing device 33. The toner container 50 includes a container body 51 which is the main location where the toner is stored, a cylindrical part 52 which protrudes from the bottom part of one side face of the container body 51, a cover member 53 which covers the other side face of the container body 51, and a rotating member 54 which conveys the toner housed inside the container. The toner stored in the toner container 50 is supplied inside the developing device 33 from a toner discharge outlet 521 provided to the bottom tip face of the cylindrical part 52 by the rotating member 54 by rotatively driven. Moreover, the container top panel 50H which covers the upside of the toner container 50 is positioned below the paper discharging unit 13 (refer to FIG. 2).

The body housing 10 internally includes a main feeding path 22F and a reverse feeding path 22B for feeding the sheets. The main feeding path 22F extends from the sheet supplying unit 21A of the paper feeding unit 20 to the paper discharge outlet 14, which is provided in a manner of facing the top face of the body housing 10, via the image forming unit 30 and the fixing unit 40. The reverse feeding path 22B is a feeding path for returning the sheet subject to one-side printing to the upstream side of the image forming unit 30 in the main feeding path 22F upon performing both-side printing to the sheet.

The main feeding path 22F (sheet feeding path) is extended in a manner of passing the transfer nip part, which is formed from the photoreceptor drum 31 and the transfer roller 34, in a direction of down to up. Moreover, a resist roller pair 23 is disposed on a side of the main feeding path 22F that is further upstream than the transfer nip part TP. The sheet is once stopped by the resist roller pair 23 and the skew correction of the sheet is performed. Subsequently, at a predetermined timing for transferring the image, the sheet is once again fed toward the transfer nip part TP. At the appropriate locations of the main feeding path 22F and the reverse feeding path 22B, a plurality of transport rollers for transporting the sheets are disposed and, for example, a paper discharge roller pair 24 is disposed near the paper discharge outlet 14.

The reverse feeding path 22B is formed between the outer face of the reversal unit 25 and the inner face of the rear cover 12 of the body housing 10. Note that the transfer roller 34 and one roller of the resist roller pair 23 are mounted on the inner face of the reversal unit 25. The rear cover 12 and the reversal unit 25 are respectively turnable around the axis of the fulcrum point 121 provided to the lower ends thereof. When a sheet jam occurs in the reverse feeding path 22B, the rear cover 12 is opened. When a sheet jam occurs in the main feeding path 22F, or when the units of the photoreceptor drum 31 or the developing device 33 is to be removed outside, the reversal unit 25 is opened in addition to the rear cover 12.

Figure 4:
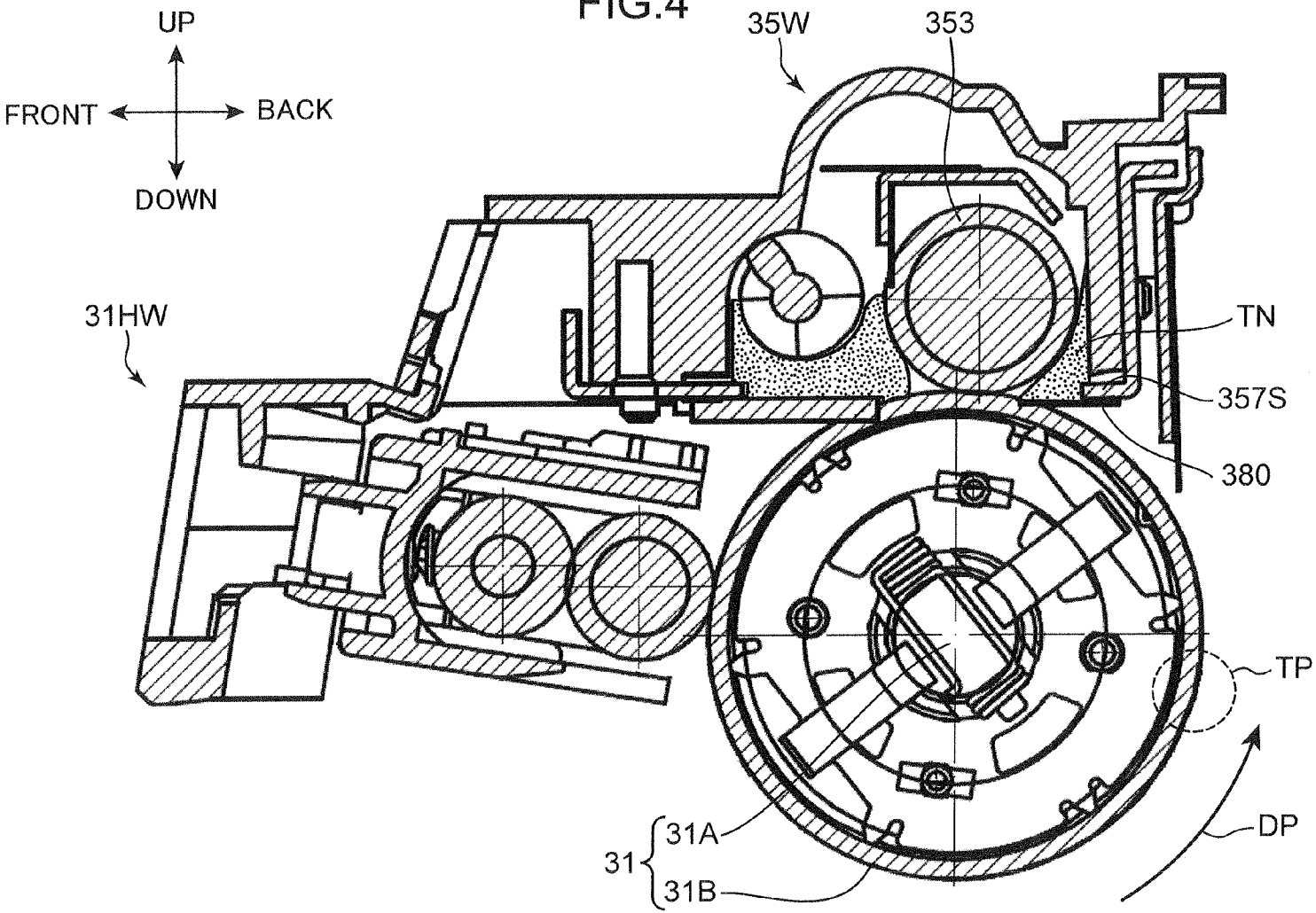
FIG. 4 is a lateral cross section showing the internal structure of the image carrier unit to be compared with the present disclosure.

Referring to FIG. 3 to FIG. 6, the configuration of the drum unit 31H according to this embodiment and conventional problems are explained in detail. FIG. 3 is an enlarged cross section of the drum unit 31H according to this embodiment. Moreover, FIG. 4 is an enlarged cross section of the drum unit 31HW for comparison with the drum unit 31H. Note that FIG. 3 and FIG. 4 are illustrated as diagrams which invert the left-right direction on the plane of paper (front-back direction of the image forming apparatus 1) in FIG. 2.

Referring to FIG. 3, the drum unit 31H includes a photoreceptor drum 31, a charging device 32, and a cleaning device 35. The drum unit 31H includes a pair of side plates (supports) not shown at either end in the left-right direction (direction that is orthogonal to the plane of paper of FIG. 3). The photoreceptor drum 31 is rotatably supported by the pair of side plates. Moreover, the charging device 32 and the cleaning device 35 are supported facing the photoreceptor drum 31 by the pair of side plates. The photoreceptor drum 31 is rotatively driven in the arrow DP direction in FIG. 3. Moreover, the drum unit 31H includes a fixing part (not shown) disposed on the side plate. When the drum unit 31H is mounted on the body housing 10 of the image forming apparatus 1, the fixing part is fixed to the body housing 10 of the image forming apparatus 1. Consequently, the position of the drum unit 31H is fixed in the image forming apparatus 1. The fixing part is configured from a fastening hole to which a screw is fastened.

The charging device 32 is disposed further on the front side than the photoreceptor drum 31. The charging device 32 includes a charge roller 321, a cleaning roller 322, and a charge housing 32H. The charge housing 32H has a substantial U-shape in a cross section view that is orthogonal to the rotating axis 31A of the photoreceptor drum 31. A charge roller 321 and a cleaning roller 322 are respectively rotatably supported in the charge housing 32H.

The charge roller 321 is a roller member in which the surface thereof is configured from a rubber material. A charged voltage is applied to the charge roller 321 from a bias application part not shown. The charge roller 321 is rotated by following the photoreceptor drum 31 as a result of coming into contact with the cylindrical face 31B of the photoreceptor drum 31. The cylindrical face 31B of the photoreceptor drum 31 is uniformly charged by the charge roller 321 to which a charged voltage was applied.

The cleaning roller 322 comes into contact with the charge roller 321, and rotates together with the charge roller 321 with a linear velocity difference. The cleaning roller 322 is a brush roller formed from conductive nylon fiber. As a result of the charge roller 321 coming into contact with the cylindrical face 31B of the photoreceptor drum 31, toner and extraneous matter become attached to the surface of the charge roller 321. Moreover, as a result of a charged voltage being applied to the charge roller 321 and a discharge occurring at the contact position with the photoreceptor drum 31, discharge products become attached to the surface of the charge roller 321. As a result of the cleaning roller 322 rotating with a linear velocity difference while contacting the charge roller 321, the toner and extraneous matter attached to the surface of the charge roller 321 can be suitably removed.

The cleaning device 35 is disposed above the photoreceptor drum 31. The cleaning device 35 includes a cleaner housing 35H, a cleaning blade 351, a conveying screw 352, and a polishing roller 353. Moreover, the cleaning device 35 includes a scraper 354, a scraper holder 355, and a top part seal 356. In addition, the cleaning device 35 includes a first plate 357, a protective sheet 361, a second plate 358, a cover seal 359, and a toner seal 360.

The cleaner housing 35H is a case which supports the respective members in the cleaning device 35. The cleaning device 35 is disposed so as to cover the upside of the photoreceptor drum 31 and the charging device 32. In particular, the front portion of the cleaner housing 35H is disposed above the charge roller 321. Moreover, in a cross section view that is orthogonal to the rotating axis 31A of the photoreceptor drum 31, the center portion of the cleaner housing 35H in the front-back direction has a shape that protrudes cylindrically upward. In addition, the rear portion of the cleaner housing 35H is demarcated by a housing rear wall 35H1 (wall part). The housing rear wall 35H1 is a wall part that extends in a vertical direction. The housing rear wall 35H1 is disposed to face the polishing roller 353 described later. The lower end of the housing rear wall 35H1 is disposed at a given spacing from the cylindrical face 31B of the photoreceptor drum 31. Moreover, the lower end of the housing rear wall 35H1 is disposed above the toner seal 360 described later at a given spacing and covers the upside of the toner seal 360.

The cleaning blade 351 is disposed in the horizontal direction along the base part of the cleaner housing 35H. The cleaning blade 351 is a plate-shaped member configured from a rubber material. The cleaning blade 351 is supported by the blade holder 351H. The blade holder 351H is an L-shaped metal plate member in the cross section view. The center portion of the blade holder 351H is fixed to the cleaner housing 35H by the first fixing screw 351B. The cleaning blade 351 and the blade holder 351H are fixed using an adhesive. Consequently, a fixing end of the cleaning blade 351 is formed. Meanwhile, the tip of the cleaning blade 351 is a free end, and comes into contact with the cylindrical face 31B of the photoreceptor drum 31. The tip of the cleaning blade 351 comes into contact with the cylindrical face 31B on a side that is further downstream in the rotating direction (arrow DP direction) of the photoreceptor drum 31 than the polishing roller 353 described later. Consequently, the toner remaining on (attached to) the cylindrical face 31B of the photoreceptor drum 31 is removed with the tip of the cleaning blade 351.

The conveying screw 352 is rotatably supported by the cleaner housing 35H above the cleaning blade 351. The conveying screw 352 includes a shaft, and a spiral fin member disposed around the shaft. The conveying screw 352 conveys, in an axial direction of the rotating axis 31A of the photoreceptor drum 31, the recovered toner PT that was wiped by the cleaning blade 351 and accumulated on the cleaning blade 351.

The polishing roller 353 is disposed at the rear of the conveying screw 352. The polishing roller 353 includes a peripheral face which comes into contact with the cylindrical face 31B positioned higher than the rotating axis 31A of the photoreceptor drum 31. Moreover, the polishing roller 353 comes into contact with the cylindrical face 31B of the photoreceptor drum 31 from the transfer nip part TP up to a position that is immediately above the rotating axis 31A of the photoreceptor drum 31. More specifically, the polishing roller 353 comes into contact with the cylindrical face 31B immediately above the rotating axis 31A of the photoreceptor drum 31 or on a side that is slightly further upstream in the rotating direction of the photoreceptor drum 31 than the position that is immediately above the rotating axis 31A of the photoreceptor drum 31. The position on the cylindrical face 31B where the polishing roller 353 comes into contact is defined as the contact position CP. The polishing roller 353 is a rubber roller in which the surface thereof was subject to roughening treatment. The polishing roller 353 rotates by following the photoreceptor drum 31 while coming into contact with the cylindrical face 31B of the photoreceptor drum 31 (arrow DC). The polishing roller 353 recovers the toner attached to the cylindrical face 31B of the photoreceptor drum 31. Moreover, the polishing roller 353 grinds extraneous matter such as discharge products that became attached to the cylindrical face 31B of the photoreceptor drum 31. Here, as a result of attaching a predetermined amount of toner to the peripheral face of the polishing roller 353, removal performance (grind performance) of the discharge products can be improved.

The scraper 354 (restricting member) is a plate-shaped member extending in the up-down direction (vertical direction). In this embodiment, the scraper 354 is configured from an SUS plate having a thickness of 0.05 mm. The lower end of the scraper 354 comes into contact with the peripheral face of the polishing roller 353. The lower end of the scraper 354 comes into contact with the peripheral face of the polishing roller 353 opposite to the rotating direction (arrow DC direction, against direction) of the polishing roller 353. As a result of the scraper 354 coming into contact with the peripheral face of the polishing roller 353 based on predetermined elastic force, the amount of toner attached to the peripheral face of the polishing roller 353 is restricted. Consequently, the amount of toner that becomes attached to the peripheral face of the polishing roller 353 becomes uniform, and variation in the removal performance of the discharge products by the polishing roller 353 is thereby inhibited.

The scraper holder 355 is disposed so as to cover the upside of the polishing roller 353. The scraper holder 355 is configured from a bent plate member. The center part of the scraper holder 355 extends in the horizontal direction. The front portion of the scraper holder 355 is bent downward, and supports the scraper 354. Moreover, the rear portion of the scraper holder 355 is bent rearward and downward along the peripheral face of the polishing roller 353.

The top part seal 356 is fixed on the scraper holder 355. One end of the top part seal 356 is supported at the center part of the scraper holder 355, and the other end of the top part seal 356 is disposed to protrude forward from the scraper holder 355. The top part seal 356 has a function of blocking the toner that becomes airborne upon the toner attached to the peripheral face of the polishing roller 353 being scraped by the scraper 354.

The first plate 357 is disposed facing the housing rear wall 35H1 of the cleaner housing 35H. The first plate 357 is a plate member extending in the up-down direction. The center part of the first plate 357 in the up-down direction is fixed to the housing rear wall 35H1 by the second fixing screw 357B. Moreover, the first plate top part 357T as the upper side end part of the first plate 357 is bent rearward. In addition, the first plate bottom part 357S as the lower side end part of the first plate 357 is bent forward. Here, the first plate bottom part 357S is disposed facing the lower end of the housing rear wall 35H1 and so as to be inserted between the lower end of the housing rear wall 35H1 and the cylindrical face 31B of the photoreceptor drum 31. Moreover, the first plate bottom part 357S is disposed above the toner seal 360 described later at a given spacing, and covers the toner seal 360.

The protective sheet 361 is configured from a thin plate-shaped elastic material. In this embodiment, the protective sheet 361 is a urethane sheet having a thickness of 100 μm. The protective sheet 361 is disposed on the top face of the bent first plate bottom part 357S. The protective sheet 361 is configured from a protective base end 361T that is bonded with and fixed to the top face of the first plate bottom part 357S, and a protective leading end 361S which protrudes further forward than the first plate bottom part 357S. To put it differently, the protective base end 361T forms the fixing end of the protective sheet 361, and the protective leading end 361S forms the free end of the protective sheet 361.

The second plate 358 is disposed facing the first plate 357 at the rear of the first plate 357. The second plate 358 is a plate member extending in the up-down direction. The second plate top part 358T as the upper end part of the second plate 358 is bent in the rear direction, and thereafter bent to curve upward. Moreover, the second plate 358 is fixed to the cleaner housing 35H with a fixing screw not shown outside the paper feeding region. The second plate bottom part 358S as the lower end part of the second plate 358 is disposed in a manner of bending forward. The second plate bottom part 358S is disposed parallel to the first plate bottom part 357S at the rear side of the first plate bottom part 357S.

The cover seal 359 extends in the up-down direction along the second plate 358. The upper portion of the cover seal 359 is bonded with and fixed to the second plate 358, and forms the fixing end of the cover seal 359. Moreover, the lower portion of the cover seal 359 is disposed to protrude downward from the second plate 358, and forms the free end of the cover seal 359. The leading end on the lower side of the cover seal 359 is disposed close to cylindrical face 31B of the photoreceptor drum 31.

The toner seal 360 (sheet member) extends in a horizontal direction along the second plate bottom part 358S of the second plate 358. The toner seal 360 is a urethane sheet having a thickness of 100 μm. The rear portion of the toner seal 360 is bonded with and fixed to the second plate bottom part 358S, and forms the fixing end 360F of the toner seal 360. Meanwhile, the leading end 360S (FIG. 8) of the front portion of the toner seal 360 forms the free end of the toner seal 360 and comes into contact with the cylindrical face 31B of the photoreceptor drum 31. The leading end 360S of the toner seal 360 comes into contact with the cylindrical face 31B at a position that is higher than the rotating axis 31A and on a side that is further upstream in the rotating direction of the photoreceptor drum 31 than the polishing roller 353 in a cross section view that is orthogonal to the rotating axis 31A of the photoreceptor drum 31. The toner seal 360 comes into contact with the cylindrical face 31B toward a direction that approaches the reference straight line RL that connects the rotating axis 31A and the contact position CP of the polishing roller 353 from the second plate bottom part 358S as the position separated from the cylindrical face 31B of the photoreceptor drum 31 in a cross section view that is orthogonal to the rotating axis 31A of the photoreceptor drum 31. The toner seal 360 has a function of preventing the toner from leaking from the inside of the cleaner housing 35H.

The first plate bottom part 357S of the first plate 357 and the housing rear wall 35H1 are disposed above the front portion of the toner seal 360. In other words, the first plate bottom part 357S and the housing rear wall 35H1 are disposed above the toner seal 360 such that the toner seal 360 protrudes further toward the front side (polishing roller 353 side) than the fixing end 360F fixed to the second plate bottom part 358S.

Figure 8:
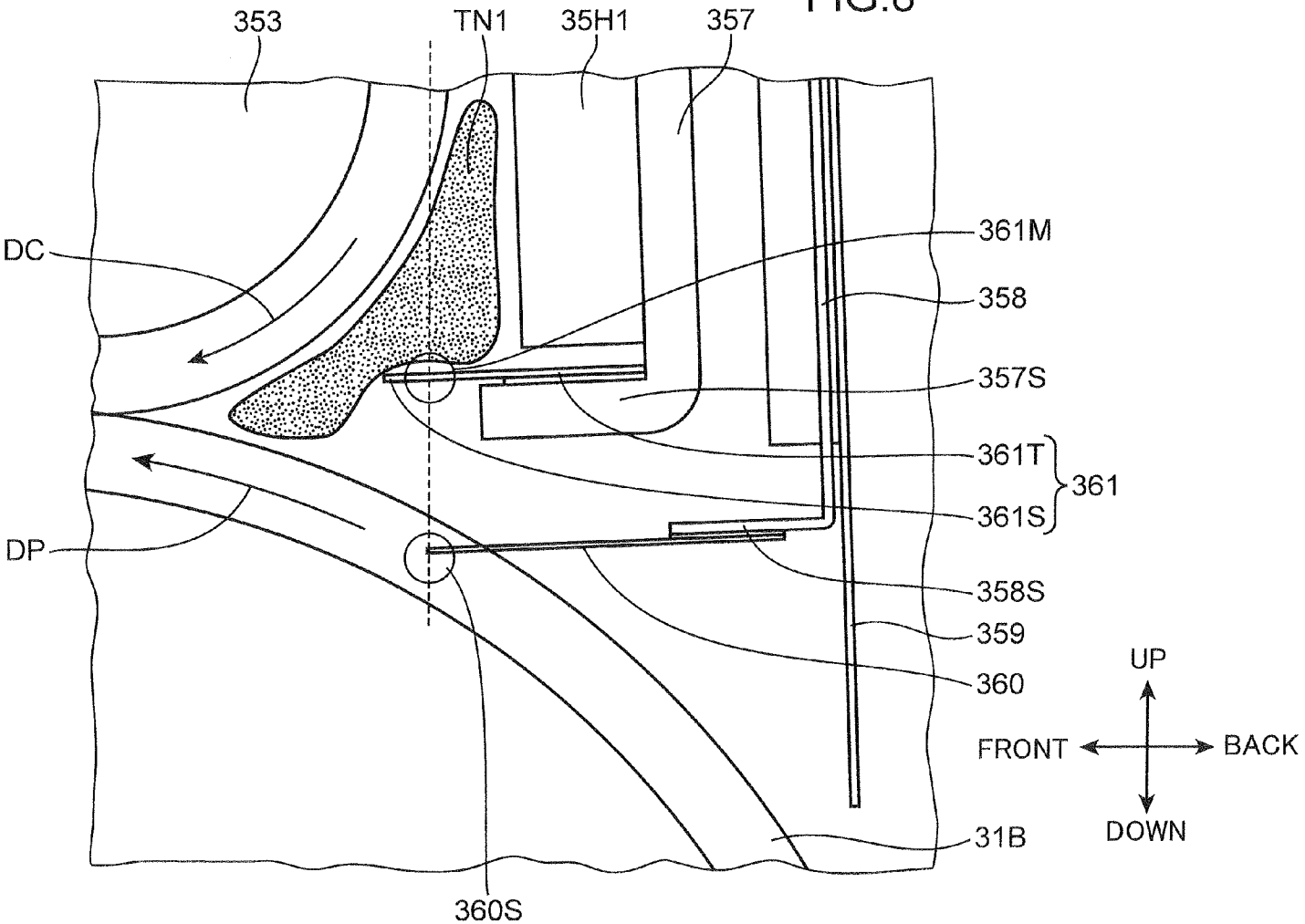
FIG. 8 is an enlarged cross section of a part of FIG. 3.

Moreover, the foregoing protective sheet 361 is disposed above the toner seal 360. The protective sheet 361 is provided to the first plate bottom part 357S so as to cover the upside of the toner seal 360. The protective sheet 361 extends, in the cross section view that is orthogonal to the rotating axis 31A of the photoreceptor drum 31, from the first plate bottom part 357S as a position that is separated from the cylindrical face 31B of the photoreceptor drum 31 toward a direction which approaches the reference straight line RL that connects the rotating axis 31A and the contact position CP of the polishing roller 353, until reaching the position 361M above the leading end 360S of the front portion of the toner seal 360 (FIG. 8). In addition, the protective sheet 361 extends so as to protrude further toward the direction of approaching the reference straight line RL than the position 361M above the leading end 360S. Moreover, the protective sheet 361 extends parallel to the direction that the toner seal 360 extends.

An electrostatic latent image is formed on the photoreceptor drum 31 in which its peripheral face was uniformly charged by the charge roller 321 of the charging device 32 by an exposure device not shown on a side that is further downstream in the rotating direction than the charging device 32. Subsequently, the electrostatic latent image is visualized as a toner image by the developing device 33 (FIG. 2) disposed below the photoreceptor drum 31. The photoreceptor drum 31 is rotated in a direction of down to up at the transfer nip part TP. In addition, the toner image formed on the photoreceptor drum 31 is transferred on the sheet that is transported in a direction of down to up at the transfer nip part TP.

At the transfer nip part TP, a part of the toner image that was transferred to the sheet will remain on the photoreceptor drum 31 as residual toner. The residual toner on the photoreceptor drum 31 is conveyed to the region where the cleaning device 35 faces the photoreceptor drum 31 in a direction of down to up in response to the rotation of the photoreceptor drum 31.

A part of the residual toner that was conveyed to the region facing the cleaning device 35 becomes attached to the peripheral face of the polishing roller 353. Moreover, the residual toner that did not become attached to the peripheral face of the polishing roller 353 is wiped by the cleaning blade 351.

The problems of a toner seal member (sheet member) provided to the cleaning device 35 are now explained. A part of the toner attached to the peripheral face of the polishing roller 353 is wiped by the scraper 354. The toner that remains on the peripheral face of the polishing roller 353 as a result of exceeding the leading end of the scraper 354 circles above the polishing roller 353 while passing through the region facing the scraper holder 355 and the housing rear wall 35H1. Here, based on the centrifugal force of the polishing roller 353, the toner attached to the peripheral face of the polishing roller 353 becomes separate from the polishing roller 353. The toner separated from the polishing roller 353 is dispersed to a region surrounded by the scraper holder 355, the housing rear wall 35H1 and the peripheral face of the photoreceptor drum 31.

FIG. 4 is a diagram for comparison with the cleaning device 35 according to an embodiment of the present disclosure, and is a cross section of a drum unit 31HW having a cleaning device 35W. The cleaning device 35W includes a toner seal 380. The toner seal 380 is configured, as with the toner seal 360, from a urethane sheet disposed in the horizontal direction. The rear portion of the toner seal 380 is fixed and supported by the first plate bottom part 357S. Moreover, the front portion of the toner seal 380 configures a free end and comes into contact with the peripheral face of the photoreceptor drum 31. The cleaning device 35W differs from the foregoing cleaning device 35 in that it does not includes the foregoing protective sheet 361 above the toner seal 380.

Figure 5:
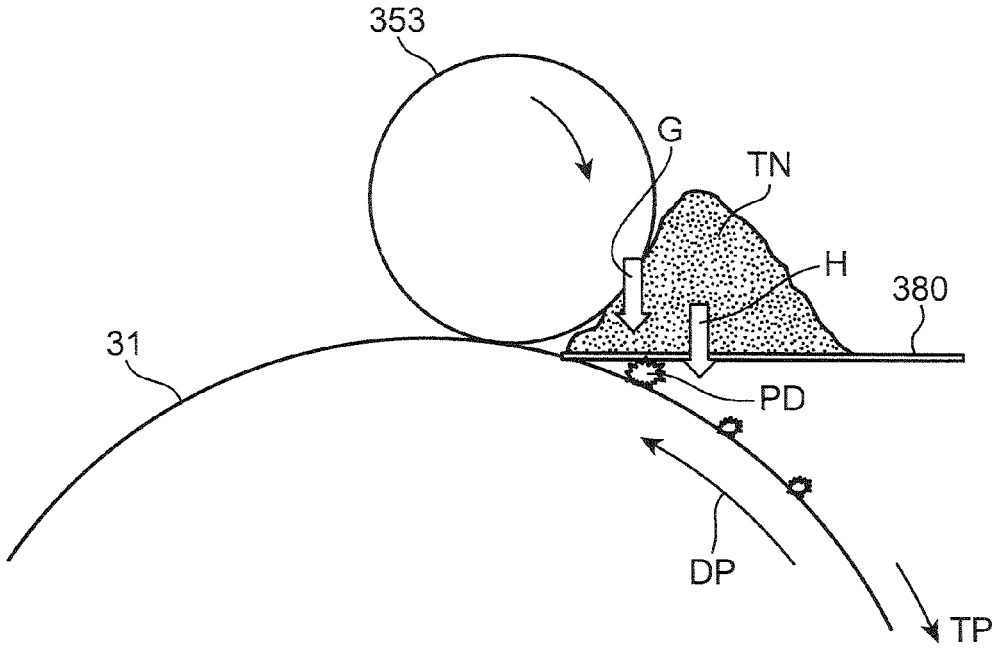
FIG. 5 is a schematic diagram explaining a state where the toner is accumulated on the toner seal of FIG. 4.
Figure 6:
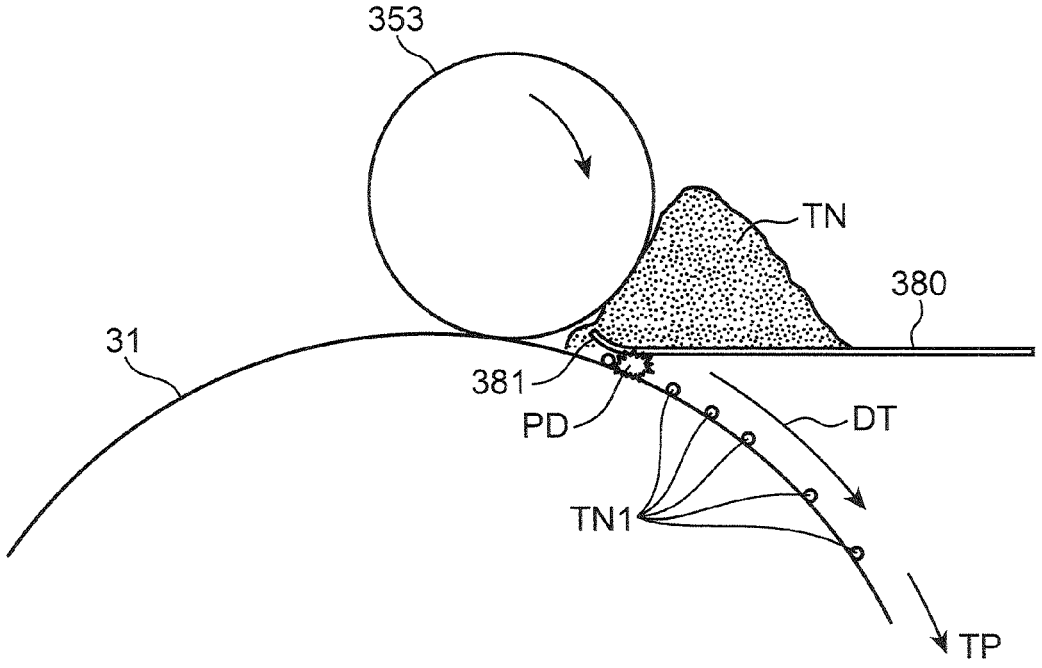
FIG. 6 is a schematic diagram explaining the state where the leading end of the toner seal of FIG. 4 is lifting due to a clump of paper dust.
Figure 7:
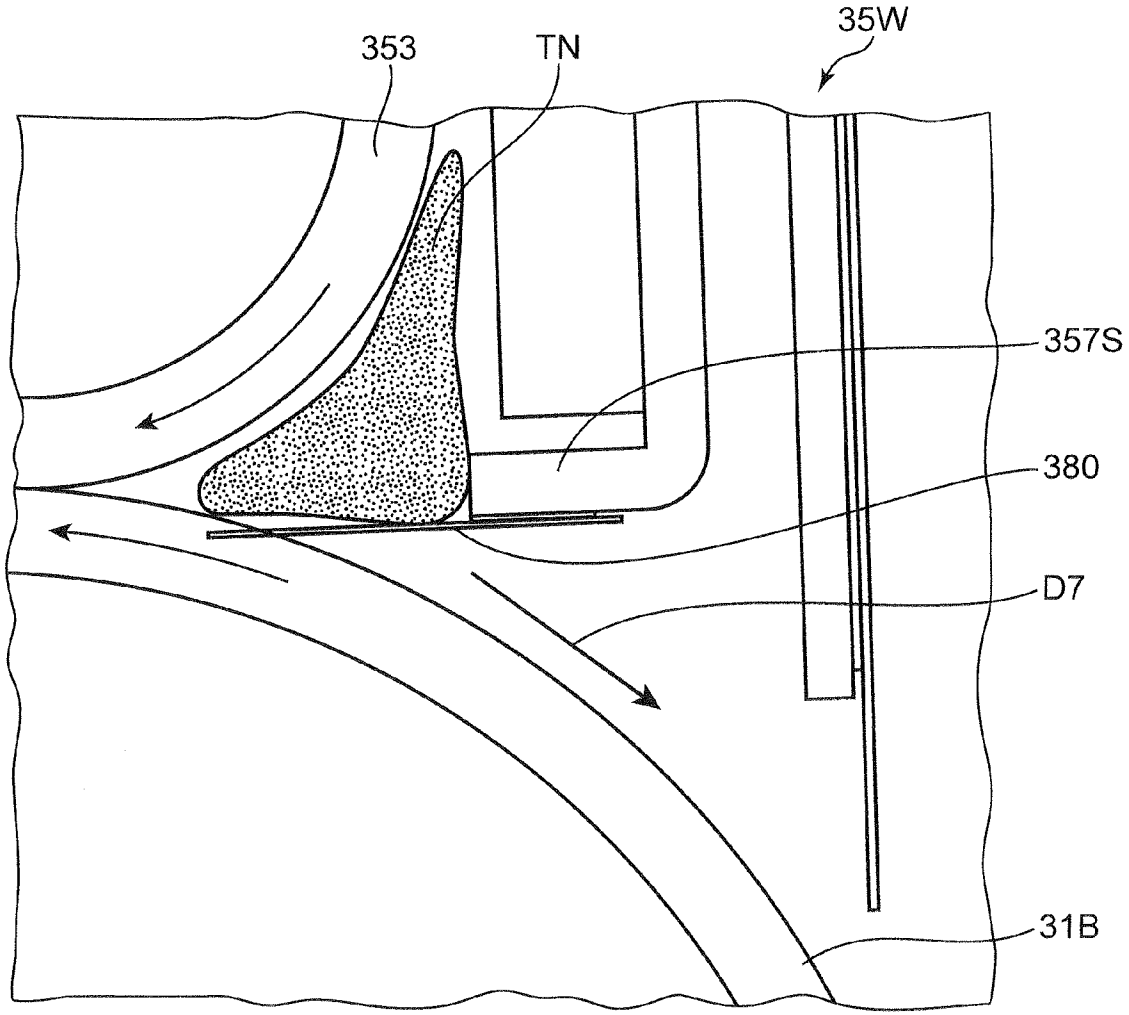
FIG. 7 is an enlarged cross section of a part of FIG. 4.

The toner dispersed from the peripheral face of the polishing roller 353 accumulates on the toner seal 380 and forms toner residue TN. FIG. 5 and FIG. 6 are diagrams showing the state around the toner seal 380 in the foregoing case. FIG. 7 is an enlarged view of a part of the drum unit 31HW (FIG. 4) within the portion schematically shown in FIG. 5 and FIG. 6. Referring to FIG. 5, the toner residue TN dispersed on the toner seal 380 is accumulated in the form of a mountain shape. Consequently, based on the own weight of the toner residue TN, pressing force as shown with the arrow H is applied to the toner seal 380. When the toner dispersed on the toner seal 380 is accumulated, the inclined face of the toner residue TN comes into contact with the peripheral face of the polishing roller 353. Thus, as shown with the arrow G, downward pressing force is applied to the toner residue TN in response to the rotation of the polishing roller 353. Consequently, the contact pressure that the toner seal 380 applies to the peripheral face of the photoreceptor drum 31 will increase.

Meanwhile, there are cases where the paper dust attached to the surface of the sheet P is transferred to the peripheral face of the photoreceptor drum 31 upon the toner image being transferred to the sheet P at the transfer nip part TP. The paper dust attached to the peripheral face of the photoreceptor drum 31 is conveyed toward the tip of the toner seal 380 in response to the rotation of the photoreceptor drum 31. When toner residue TN is not formed on the toner seal 380, the tip of the toner seal 380 is in contact with the peripheral face of the photoreceptor drum based on low contact pressure. In the foregoing case, the paper dust conveyed to the photoreceptor drum 31 passes between the tip of the toner seal 380 and the peripheral face of the photoreceptor drum 31, and is recovered by the polishing roller 353 and the cleaning blade 351.

Nevertheless, in cases where the tip of the toner seal 380 is in strong contact with the peripheral face of the photoreceptor drum 31 due to the toner residue TN accumulated on the toner seal 380, the paper dust cannot pass between the tip of the toner seal 380 and the peripheral face of the photoreceptor drum 31. Consequently, as shown in FIG. 5, a clump PD of paper dust is formed between the tip of the toner seal 380 and the peripheral face of the photoreceptor drum 31.

Eventually, when the clump PD of paper dust grows, the tip 381 of the toner seal 380 will lift off the peripheral face of the photoreceptor drum 31 in correspondence with the portion where the clump PD exist in the axial direction of the rotating axis 31A of the photoreceptor drum 31 (FIG. 6). Consequently, the toner TN1 will begin to leak from the toner residue TN. The toner TN1 will fall along the peripheral face of the photoreceptor drum 31 according to gravity (arrow DT of FIG. 6, arrow D7 of FIG. 7). In addition, the toner TN1 that reached the transfer nip part TP becomes attached to the sheet P that was transported to the transfer nip part TP. Consequently, the sheet P is contaminated by the toner.

As described above, the toner seal 380 generates a clump PD of paper dust and the sheet P is contaminated by the toner.

In order to resolve the foregoing problem, with the cleaning device of this embodiment, the protective sheet 361 is suitably disposed above the toner seal 360. FIG. 8 is an enlarged view of the periphery of the toner seal 360 and the protective sheet 361 in FIG. 3.

In this embodiment, as shown in FIG. 8, the foregoing protective sheet 361 is disposed above the toner seal 360. The protective sheet 361 is provided to the first plate bottom part 357S so as to cover the upside of the toner seal 360. The protective sheet 361 extends, in a cross section view that is orthogonal to the rotating axis 31A of the photoreceptor drum 31, from the first plate 357 side to the position 361M above the leading end 360S of the toner seal 360 in a direction which approaches the reference straight line RL (FIG. 3) that connects the rotating axis 31A and the contact position CP of the polishing roller 353. In addition, the protective sheet 361 extends in a manner of protruding further toward a direction of approaching the reference straight line RL (FIG. 3) than the position 361M above the leading end 360S of the toner seal 360.

Consequently, the toner that was dispersed from the polishing roller 353 accumulates on the protective sheet 361 as shown in FIG. 8. Thus, it is possible to inhibit the toner from accumulating on the toner seal 360. The toner accumulated on the protective sheet 361 is guided to the rotating face 31B side of the photoreceptor drum 31 based on the rotative force of the polishing roller 353. Here, since the protective sheet 361 is deformable based on elastic force, the toner will not be hardened pressed (rammed down) between the peripheral face of the polishing roller 353 and the protective sheet 361. Moreover, as a result of the protective leading end 361S of the protective sheet 361 being deformed downward in accordance with the rotative force of the polishing roller 353, the transfer of the toner to the photoreceptor drum 31 side is promoted.

As described above, with the cleaning device 35 according to this embodiment, the protective sheet 361 effectively inhibits the toner from becoming accumulated on the toner seal 360. Thus, it is possible to inhibit the increase of the contact pressure of the toner seal 360 against the photoreceptor drum 31 as a result of the toner becoming accumulated on the toner seal 360. Accordingly, it becomes difficult for a clump of the paper dust PD to be formed between the leading end 360S of the toner seal 360 and the rotating face 31B of the photoreceptor drum 31. Thus, it is possible to inhibit the occurrence of toner leakage as a result of the leading end 360S of the toner seal 360 lifting off the rotating face 31B of the photoreceptor drum 31. Consequently, it is possible to effectively inhibit the sheet P, which is transported to the transfer nip part TP, from becoming contaminated by the toner that falls downward from the leading end 360S of the toner seal 360.

Particularly, in the foregoing embodiment, the protective sheet 361 is disposed to protrude even further than the upward position 361M of the leading end 360S of the toner seal 360. Thus, it becomes difficult for the toner that was dispersed from the rotating member to reaching the toner seal 360.

In addition, in this embodiment, the first plate bottom part 357S and the housing rear wall 35H1 are disposed above the toner seal 360 to protrude further toward the front side (polishing roller 353 side) than the fixing end 360F (FIG. 3) in which the toner seal 360 is fixed to the second plate bottom part 358S. To put it differently, the first plate bottom part 357S of the first plate 357 is disposed so as to cover the upside of the toner seal 360. Moreover, the lower end of the housing rear wall 35H1 is disposed above the first plate bottom part 357S. Thus, the upside space of the toner seal 360 is covered by more members, and the accumulation of toner on the toner seal 360 is further inhibited.

Moreover, the housing rear wall 35H1 is disposed, in a manner of facing the polishing roller 353, above the leading end 360S of the toner seal 360 and on the rear side of the peripheral face of the polishing roller 353. Thus, the toner that is dispersed from the peripheral face of the polishing roller 353 toward the rear in response to the rotation of the polishing roller 353 will collide with the housing rear wall 35H1 and fall downward. Accordingly, the housing rear wall 35H1 tends to guide the toner onto the protective sheet 361.

Moreover, in the foregoing embodiment, the protective sheet 361 tends to deform due to elastic force. Thus, the protective sheet 361 can be deformed downward based on the own weight of the toner that is accumulated on the protective sheet 361. Consequently, the toner accumulated on the protective sheet 361 tends to be guided toward the cylindrical face 31B of the photoreceptor drum 31.

Moreover, according to the foregoing embodiment, in a cross section view that intersects with the rotating axis 31A of the photoreceptor drum 31, one end of the toner seal 360 is the fixing end 360F that is fixed to the cleaner housing 35H, and the other end of the toner seal 360 is the leading end 360S configured from a free end. Thus, the leading end 360S of the toner seal 360 deforms easily as a free end. Consequently, the space between the cleaner housing 35H and the cylindrical face 31B of the photoreceptor drum 31 can more easily be blocked by the leading end 360S of the toner seal 360.

Moreover, according to the foregoing embodiment, the cleaning blade 351 is disposed on a side that is further downstream in the rotating direction of the photoreceptor drum 31 than the polishing roller 353. Thus, the toner which became attached to the photoreceptor drum 31 can be removed with accuracy. Moreover, even in cases where the toner that accumulated on the protective sheet 361 falls down and becomes attached to the cylindrical face 31B of the photoreceptor drum 31, the toner can be recovered by the polishing roller 353 and the cleaning blade 351.

Moreover, according to the foregoing embodiment, the extraneous matter that became attached to the cylindrical face 31B of the photoreceptor drum 31 is effectively ground by the polishing roller 353. Moreover, the scraper 354 restricts the amount of toner to become attached to the peripheral face of the polishing roller 353. Thus, as a result of the toner being interposed between the polishing roller 353 and the cylindrical face 31B of the photoreceptor drum 31, variation in the promoted grinding effect can be inhibited by the position on the peripheral face of the polishing roller 353.

Moreover, according to the foregoing embodiment, the polishing roller 353 comes into contact with the cylindrical face 31B of the photoreceptor drum 31 from the transfer nip part TP to the position immediately above the rotating axis 31A of the photoreceptor drum 31. Consequently, the leading end 360S of the toner seal 360 comes into contact with the cylindrical face 31B below the position CP where the polishing roller 353 comes into contact with the cylindrical face 31B and on the upstream side in the rotating direction of the photoreceptor drum 31. Thus, the toner that was dispersed from the polishing roller 353 tends to fall on the toner seal 360. Even in the foregoing case, according to the foregoing configuration, the protective sheet 361 is disposed so as to cover the upside of the toner seal 360. Accordingly, it is possible to prevent the toner from becoming accumulated on the toner seal 360. Thus, it becomes difficult for the contact pressure of the toner seal 360 against the photoreceptor drum 31 to increase, and it is possible to inhibit the occurrence of toner leakage from the leading end 360S of the toner seal 360. In addition, even in cases where the paper dust of sheets becomes attached to the cylindrical face 31B of the photoreceptor drum 31 at the transfer nip part TP, it is possible to prevent the paper dust that was transferred up to the leading end 360S of the toner seal 360 in response to the rotation of the photoreceptor drum 31 from growing into a clump between the leading end 360S of the toner seal 360 and the cylindrical face 31B of the photoreceptor drum 31. Consequently, it is possible to prevent the leading end 360S of the toner seal 360 from lifting due to the clump of the paper dust, and the toner from leaking from a gap between the toner seal 360 and the photoreceptor drum 31. Accordingly, it is possible to inhibit the toner that leaked downward from contaminating the transported sheet at the transfer nip part TP.

The drum unit 31H and the image forming apparatus 1 including the cleaning device 35 according to an embodiment of the present disclosure were explained above, but the present disclosure is not limited thereto, and may take on, for instance, the modified embodiments described below.

Figure 9:
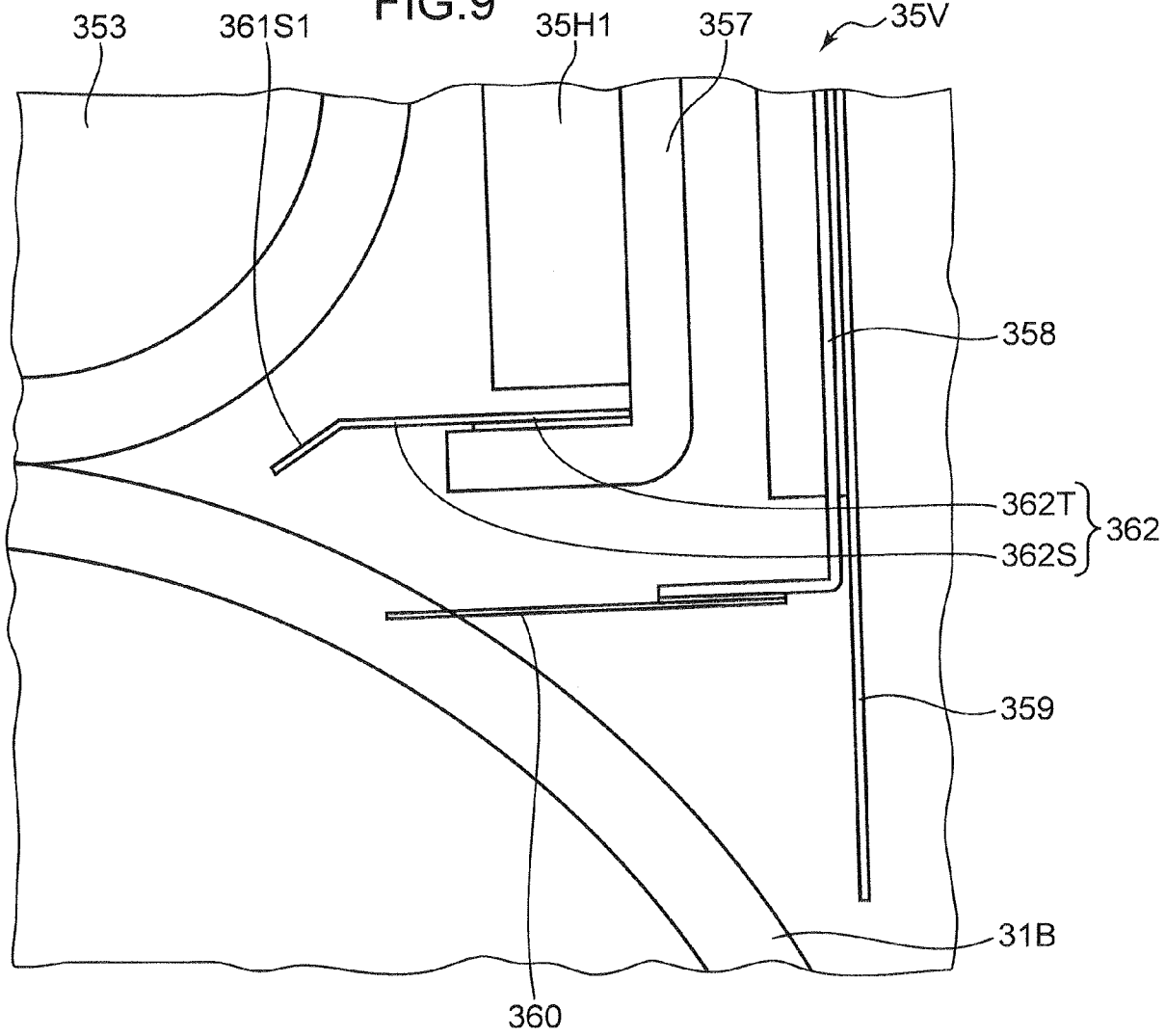
FIG. 9 is an enlarged lateral cross section of a part of the image carrier unit according to another embodiment of the present disclosure.

(1) In the foregoing embodiment, explained was a mode where the protective sheet 361 extends from the first plate bottom part 357S parallel to a direction in which the toner seal 360 extends from the second plate bottom part 358S, but the present disclosure is not limited thereto. FIG. 9 is an enlarged cross section of the cleaning device 35V including the protective sheet 362 according to another embodiment of the present disclosure. The protective sheet 362 includes a tip guiding part 361S1 at the tip of the protective leading end 362S. The tip guiding part 361S1 is formed as a result of the tip of the protective leading end 362S being bent downward. The tip guiding part 361S1 is disposed to incline toward the cylindrical face 31B of the photoreceptor drum 31. As with the protective sheet 361 according to the foregoing embodiment, the toner accumulated on the protective sheet 362 moves to the cylindrical face 31B of the photoreceptor drum 31 as a result of being guided by the tip guiding part 361S1. Thus, it is possible to inhibit large amounts of toner from being accumulated on the protective sheet 361, and the function of the protective sheet 362 protecting (covering) the upside of the toner seal 360 is favorably maintained.

(2) In the foregoing embodiment, explained was a mode where the polishing roller 353 and the cleaning blade 351 are disposed on a side that is further downstream in the rotating direction of the photoreceptor drum 31 than the toner seal 360, but the present disclosure is not limited thereto. The polishing roller 353 may also be a cleaning roller which cleans the surface of the photoreceptor drum 31. In the foregoing case, the cleaning blade 351 may be disposed on a side that is further downstream in the rotating direction of the photoreceptor drum 31 than the cleaning roller, or the mode may be such that the cleaning blade 351 is not provided.

(3) In the foregoing embodiment, explained was a mode where the protective sheet 361 as the cover member is configured from a thin plate-shaped elastic member, but the present disclosure is not limited thereto. The protective sheet 361 may also be a part of the member which configures the cleaner housing 35H. Moreover, the protective sheet 361 (cover member) may also be configured from the first plate bottom part 357S of the first plate 357.

(4) Moreover, in the foregoing embodiment, explained was a mode where the cleaning device 35 including the toner seal 360 is provided to the drum unit 31H, but the present disclosure is not limited thereto. The cleaning device 35 including the toner seal 360 may also be mounted on the image forming apparatus 1 individually.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A cleaning device which is disposed above an image carrier including a rotating axis, and a cylindrical face rotating in one direction around the rotating axis and carrying a toner image, and which cleans the cylindrical face, the cleaning device comprising:

a case;

a rotating member provided in the case and including a peripheral face that comes into contact with the cylindrical face above the rotating axis in a cross section view that is orthogonal to the rotating axis, is rotatively driven in a same direction as the image carrier at a contact position that comes into contact with the cylindrical face, and recovers a toner that has attached on the image carrier;

a sheet member provided in the case and extending horizontally, in the cross section view, from a position that is above the rotating axis and separated from the cylindrical face toward a direction approaching a straight line that connects the rotating axis of the image carrier and the contact position of the rotating member, and includes a leading end which comes into contact with the cylindrical face on a side that is further upstream in the rotating direction of the image carrier than the rotating member; and a cover member provided in the case directly above the sheet member so as to cover an upside of the sheet member, the cover member extending horizontally from a position that is separated from the cylindrical face in the cross section view toward the direction approaching the straight line, the cover member reaching a position over the leading end of the sheet member and extending farther toward the direction approaching the straight line than the leading end of the sheet member in a protruding manner.

2. The cleaning device according to claim 1, wherein a cover member leading end of the cover member on a side approaching the straight line is bent down and provided toward the cylindrical face of the image carrier.

3. The cleaning device according to claim 1, wherein the cover member is a thin plate-shaped elastic member.

4. The cleaning device according to claim 1, wherein the cover member is a part of a member which configures the case.

5. The cleaning device according to claim 1, wherein one end of the sheet member is a fixing end that is fixed to the case and the other end of the sheet member is the leading end composed of a free end, in the cross section view.

6. The cleaning device according to claim 1, further comprising:

a cleaning blade which comes into contact with the cylindrical face on a side that is further downstream in the rotating direction of the image carrier than the rotating member, and removes the toner which has attached on the image carrier.

7. The cleaning device according to claim 1, wherein the rotating member is a polishing roller which grinds extraneous matter that has attached on the cylindrical face of the image carrier, the cleaning device further includes a restricting member which comes into contact with a peripheral face of the polishing roller and restricts an amount of toner attached to the peripheral face.

8. An image forming apparatus, comprising:

an image carrier including a rotating axis, and a cylindrical face that rotates in one direction around the rotating axis and carries a toner image;

a developing device that supplies a toner to the cylindrical face of the image carrier; and a cleaning device that cleans the cylindrical face, wherein the cleaning device includes:

a case;

a rotating member provided in the case and including a peripheral face that comes into contact with the cylindrical face above the rotating axis in a cross section view that is orthogonal to the rotating axis, is rotatively driven in a same direction as the image carrier at a contact position that comes into contact with the cylindrical face, and recovers a toner that has attached on the image carrier;

a sheet member provided in the case and extending horizontally, in the cross section view, from a position that is above the rotating axis and separated from the cylindrical face toward a direction approaching a straight line that connects the rotating axis of the image carrier and the contact position of the rotating member, and includes a leading end that comes into contact with the cylindrical face on a side that is further upstream in the rotating direction of the image carrier than the rotating member; and a cover member provided in the case directly above the sheet member so as to cover an upside of the sheet member, the cover member extending horizontally from a position that is separated from the cylindrical face in the cross section view toward the direction approaching the straight line, the cover member reaching a position over the leading end of the sheet member and extending farther toward the direction approaching the straight line than the leading end of the sheet member in a protruding manner.

9. The image forming apparatus according to claim 8, wherein a cover member leading end of the cover member on a side approaching the straight line is bent down and provided toward the cylindrical face of the image carrier.

10. The image forming apparatus according to claim 8, wherein the cover member is a thin plate-shaped elastic member.

11. The image forming apparatus according to claim 8, wherein the cover member is a part of a member which configures the case.

12. The image forming apparatus according to claim 8, further comprising:

a sheet feeding path which faces the image carrier and feeds a sheet in a direction of down to up; and a transfer member which comes into contact with the cylindrical face of the image carrier to form a transfer nip part for transferring the toner image from the image carrier to the sheet, wherein the image carrier is rotatively driven in a direction of down to up at the transfer nip part, and the rotating member comes into contact with the cylindrical face of the image carrier between the transfer nip part and a position immediately above the rotating axis.

* * * * *